United States Patent [19]

Houdayer et al.

[11] Patent Number: 4,555,208

[45] Date of Patent: Nov. 26, 1985

[54] METHOD OF FITTING A METAL CLOSURE

[75] Inventors: Bernard Houdayer; Bernard Le Fur, both of La Fleche; René Meneghin, Voiron; Jean-Michel Moniod, Paris, all of France

[73] Assignee: Cebal, Clichy, France

[21] Appl. No.: 595,704

[22] Filed: Apr. 2, 1984

[30] Foreign Application Priority Data

Apr. 13, 1983 [FR] France ..... 83 06323

[51] Int. Cl.[4] ..... B21D 39/03

[52] U.S. Cl. ..... 413/2; 413/5; 413/9; 413/58; 53/488

[58] Field of Search ..... 220/309, 310; 413/5, 413/9, 26, 58, 2, 4, 6; 215/325, 327; 53/487, 488, 498, 288, 290

[56] References Cited

U.S. PATENT DOCUMENTS

| | | | |
|---|---|---|---|
| 1,276,343 | 8/1918 | Gaston | 215/325 |
| 1,713,858 | 1/1927 | Teuander | 220/309 |
| 2,196,877 | 1/1937 | Spengler | 53/488 |
| 3,104,773 | 9/1963 | Podesta et al. | 215/327 |
| 3,190,481 | 6/1965 | McKnight | 215/354 |

OTHER PUBLICATIONS

APC Application of "Method of Attaching Closure Caps", Ser. No. 265,334, Pub. 5/25/43.

*Primary Examiner*—Lowell A. Larson
*Assistant Examiner*—Robert Showalter
*Attorney, Agent, or Firm*—Dennison, Meserole, Pollack & Scheiner

[57] ABSTRACT

The invention relates to the fitting of a metal closure on a vessel of which the circular edge is a rigid beaded lip.

The method of this invention starts with a closure blank (1) of which the edge (14) has been bent through less than 180°, a thick elastic gasket (5) is positioned inside its support section (20), and then, when the closure blank (1) has been positioned under a centering press (7), it is shaped, it is fitted under the beaded lip (4) of the vessel and it is sealingly tightened in a single operation, by the movement of an annular mandrel (10) or several outer tools of the same function.

9 Claims, 5 Drawing Figures

METHOD OF FITTING A METAL CLOSURE

BACKGROUND OF THE INVENTION

The field of the invention is the working of metals and more particularly the shaping of the edges of a metal closure.

The invention is essentially directed to a method for sealing a metal closure on to a vessel with a beaded circular edge, combining two conditions for application in the mass production of preserves:

use of a closure blank of reduced diameter, for economy of metal;

a fast and simple method for fitting, if possible in a single operation.

The airtight sealing, by a metal closure, of a vessel the edge of which is a rigid beaded lip, is most often done by a succcession of mechanical operations the last of which is a bending back of the skirt of the closure, previously turned into the neck of the lip, in order to effect, by tightening, a durable engagement. This bending is done laterally, for example with one or more milling wheels.

In a different and simpler manner, U.S. Pat. No. 3,190,481 describes the fitting of a closure blank having a central depression which comes to rest in the mouth of a glass vessel, this blank having a U-shaped outer edge, which a curved concave pressing tool will progressively shape so that the U-shaped periphery is levered under the beaded edge of the vessel, thus effecting a fit.

In a similar manner in U.S. Pat. No. 1,625,245 an annular bevelled tool bends the edge of the cap blank and forces it under the outside rolled edge of the vessel.

Such methods appear simple; but the edge of the closure blank, comprising an outer roll, uses a significant quantity of metal or (other) material, which is a serious economic handicap.

SUMMARY OF THE INVENTION

The invention relates to a method of sealing a closure in which the fit is effected in a single operation by the movement of one or more shaping tools, and in which the outer edge of the closure blank has been bent, but in a much smaller extent than in the two patents cited above and with a different purpose. One essential object of this invention is economy of materials, and the method of the invention uses a closure blank with an area just sufficient to allow the extreme edge of the closure to engage under the lip of the vessel, without there being present excess metal in the form of a rolled edge or a folded hem. The outer edge of the closure blank of the invention is bent through less than 180°, typically through between 100° and 140°, and it plays a double role: it serves, on the one hand, as a guide for the shaping of the periphery of the blank, and on the other hand, near its end, as a guide for the engagement of the closure under the beaded lip of the vessel. The complex shaping of the outer part of the closure blank, culminating in its being fitted under the beaded lip of the vessel and tightened around this lip, is done by a special annular mandrel or a plurality of outer mandrels with the same function as this annular mandrel.

Whereas in the methods of U.S. Pat. Nos. 3,190,481 and 1,623,245, the edge of the hemmed or U-shaped closure blank is levered or bent and then pushed back under the beaded lip of the vessel, in the method of this invention the compound shaping mechanism for the edge of the closure blank consists of a stretching accompanied by a tightening and ending with a binding, having the overall effect of sealing the closure. Thus in the method of the invention, the edge is bent and fitted without being unrolled or levered.

In a more detailed form, the object of the invention is a method of fitting a closure on a vessel whose edge has a rigid beaded lip, by means of a fitting apparatus comprising a centering press and an annular mandrel having more particularly an inclined inner curvature and a vertical inner surface, or equally a set of outlying mandrels, this method typically comprising the following stages:

(a) a closure blank is prepared comprising a central depression with an inner side wall substantially in the shape of a truncated cone and with a diameter somewhat less than that of the mouth of the vessel, and an annular toroidal part comprising in succession: an annular supporting section, an inclined intermediate section and a concave outer edge curved inwardly and folded through less than 180° as already indicated;

(b) a thick endless elastic gasket is placed on the supporting section of the closure blank (on the inner surface of said section);

(c) the closure blank is positioned beneath the centering press of the fitting apparatus and the vessel is positioned beneath the closure blank. It is not necessary to have the vessel precisely centred at this stage: a surprising self-centering effect on the part of the vessel manifests itself when the annular mandrel starts to shape the closure blank, if then the pressure applied by the centering press is still weak, i.e. the thick elastic gasket is only lightly depressed;

(d) the closure blank furnished with the thick elastic gasket is put under increasing pressure on to the mouth of the vessel by means of the centering press until a chosen compression force is reached;

(e) during and after the stage (d) the closure blank is shaped, fitted and effectively sealed on the lip of the vessel by means of the annular mandrel alone, or of the outlying set of mandrels alone, according to the following shaping procedure:

(e1) the bent outer edge and the intermediate section of the closure blank are stretched, forced downwardly and tightened by the pressure of the annular mandrel or of the outlying set of mandrels on said bent outer edge, and by rolling of said edge in the inclined inner curvature of the ring shaped mandrel or of the outlying mandrels;

(e2) this shaping of the outer edge and of the intermediate section of the closure blank is continued, and at the same time the extremity of said outer edge is forced under the beaded lip of the vessel by the pressure of the engaging surface above the inner inclined curvature and by the engaging of the vertical inner surface of said annular mandrel around said outer edge and intermediate section, or by the pressure and engagement of the profiles and inner vertical surfaces of the outlying mandrels;

(e3) the sealed fit of the closure on to the beaded lip of the vessel is achieved by its being forced by the camming action of the vertical inner surface of the annular mandrel, or the vertical inner surfaces of the outlying mandrels, around the outer edge of the closure, this being done to a level at least below the beaded lip of the vessel.

In a preferred form of the invention this fitting is effected in a single operation by the movement of an annular mandrel in a specific direction parallel to the axis of symmetry common to the edge of the vessel and of the closure. Compared with conventional methods of forming it can be said that this fitting combines essentially a stamping method, without squashing, of the closure blank, by the anvil constituted by the rigid lip of the vessel and the die constituted by the annular mandrel, and a method of rolling the metal in a throat of the mandrel, this rolling being opposed by the exterior of the lip of the vessel.

A non-limiting example of a vessel, of which the edge has a rigid beaded lip, an example involving a glass jar, will permit a better description of the invention and explain certain details of it.

BRIEF DESCRIPTION OF THE DRAWINGS

The drawings which illustrate this example are as follows.

DESCRIPTION OF THE PREFERRED EMBODIMENTS

Figure 1:
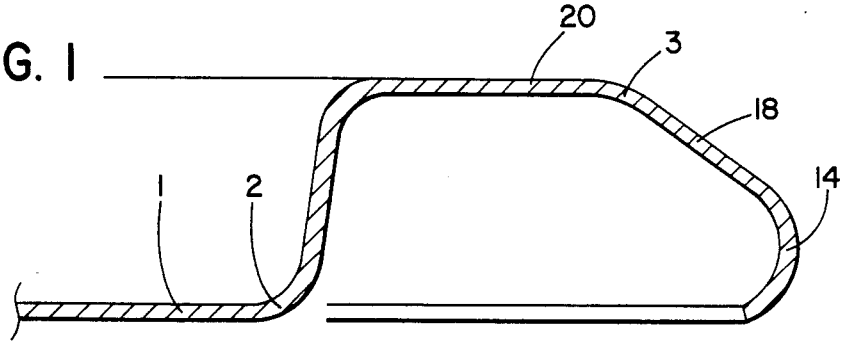
FIG. 1 represents in axial semi-cross-section a blank for a metal closure, in aluminium for example.
Figure 2:
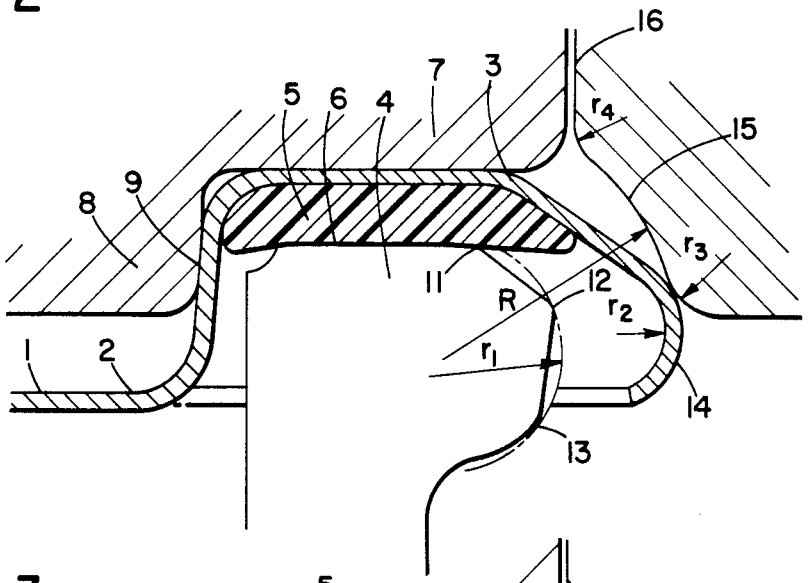
FIG. 2 represents in axial semi-cross-section the edge of the same closure blank in starting position to be fitted on to the rigid edge of a glass jar.

FIG. 1 shows the closure blank (1) which has been pre-curved by known methods in a way which allows, on the one hand, for convenient separation, and on the other, for suitability for shaping and fitting. This closure blank (1) comprises a central depression (2) and an annular toroidal part (3) which will overlap the rigid beaded lip (4) of the vessel to be capped, as shown in FIG. 2. The annular toroidal part in turn comprises, in succession, an annular support section (20), an intermediate sloped section (18) and an outer edge (14) curved inwardly, bent through about 120°. The outer edge (14) has, furthermore, in perpendicular section, a radius ($r_2$) sufficiently small (FIG. 2) that it cannot catch itself on the outer edge of the lip (4) of the vessel, and that it will engage under the lip (4) only after the shaping of the periphery (14 & 18) of the closure blank (1) by the annular mandrel.

FIG. 2 shows the closure blank (1) in position for fitting. An annular airtight elastic gasket is positioned on the upper edge or rim (6) of the lip (4), and is interposed between the lip (4) and the edge (3) of the closure, while a centering press (7) steadies the closure (1) and holds its position relative to the lip (4) of the jar thanks to the mutual action of its protrusion (8) and the quasi-truncated conical periphery (9) of the central depression (2) of said closure. An annular mandrel (10) having a vertical locus of movement controlled by an elastic screw-jack surrounds the centering press (7) with slight clearance, the centering press serving equally to ensure the centering of this mandrel (10) with respect to the lip (4) of the jar. The outer edge (11, 12, 13) of the lip (4) can be inscribed in a circle of radius ($r_1$) while the inner radius ($r_2$) of the outer edge (14) of the closure is just smaller than ($r_1$) and the radius (R) of the profile (15) of the annular mandrel (10) is greater than ($r_1$). The profile (15) of the annular mandrel is continuous with a ridge of radius ($r_3$) at the lower part and with a ridge of radius ($r_4$) at the central vertical opening (16). The working parts of the mandrel, namely the profile (15) and its attendant ridges ($r_3$) and ($r_4$) as well as the lower part of the central vertical opening (16), are of a hardness and a type of surface suitable to function in rolling and fitting the metal closure, of aluminium in the present case.

Figure 3:
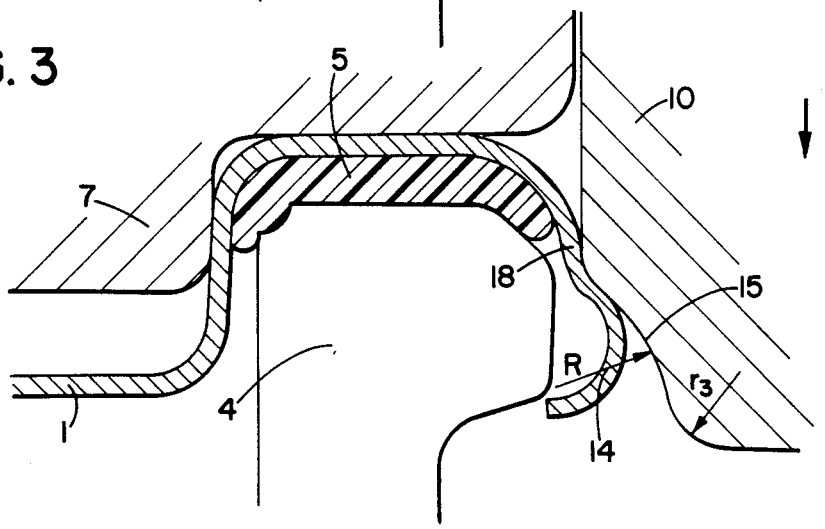
FIG. 3 represents in axial semi-cross-section the closure during the rolling stage of fitting.

The closure, thus positioned in the fitting apparatus between the lip (4) of the glass jar topped with the airtight gasket (5) and the centering press (7) surrounded by the mobile annular mandrel (10), the fitting method starts with an initial rolling phase (FIG. 3) in which the annular mandrel (10) descends vertically as indicated by the arrow, causing progressive contact firstly between the ridge ($r_3$) and the outer edge (14) of the closure, and then between the profile (15) of radius (R) with the part (18) of the closure immediately adjoining that edge (14), and forcing them down and under the lower part of the lip by a rolling effect in the peripheral profile (15) inclined and curved similarly to radius (R). In a surprising manner an effect of self-centering of the vessel under the closure (1) is achieved at the beginning of the shaping of said closure, by a spontaneous equilibration of the forces restraining the cap by means of the annular mandrel. This self-centering effect facilitates the performance of the method.

This surprising effect of self-centering removes the need to precisely centre the vessel with respect to the vertical axis of symmetry of the centering-press and of the closure blank, for example to any better than 0.3 to 0.5 mm of that axis. When the jar is off-centre and when the pressure of the closure blank (1) on the lip (4) of the vessel is still small, for example less than a quarter of the maximum chosen pressure, the annular mandrel (10) presses obliquely on the perimeter (14) of the closure blank (1), and it seems that the transmission of the oblique pressure on the lip (4) of the vessel by the intermediate sloped section (18) and by the elastic gasket (5) suffice to shift the vessel in such a way that the balance of pressures causes a precise centering of the vessel. This self-centering effect, linked to the progressive intervention of the centering press, is an important advantage in the method, particularly in the case of glass containers.

As the annular mandrel (10) pursues its descent (FIG. 4), the area of engagement of the ridge ($r_4$) and the vertical surface (16) of the central opening of the mandrel (10) continue to exercise an effect of rolling the closure material around under the lower part of the lip, and exercise also a compressive effect on the part already rolled (14) and the immediately adjacent part (18).

Figure 5:
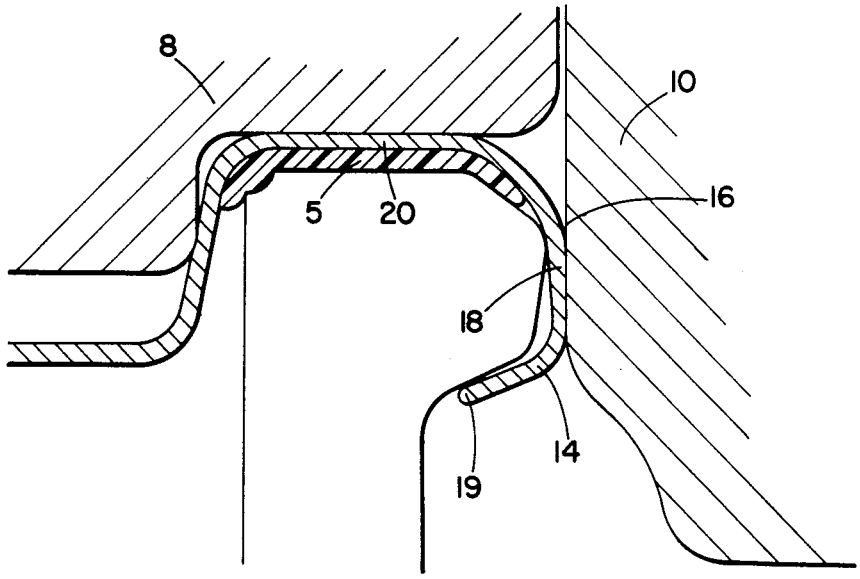
FIG. 5 represents in axial semi-cross-section the closure in the fitted state.

When the descent of the annular mandrel (10) is complete (FIG. 5) the periphery of the closure (1) has been secured to the lip (4) of the vessel by the camming action of the inner vertical surface (16) on the edge (14+18) of the closure (1), this action, applied on the periphery of the beaded lip (4), camming through until the vertical surface (16) reaches a level below the lip (4). While pressing the edge (14+18) of the closure (1), the inner surface (16) of the annular mandrel (10) has chased the extremity (19) of the outer edge (14) of the closure. The consequent tensioning of the closure as well as the action of the centering press (7) has caused a progressive compression of the airtight gasket (5) by the upper part (20) of the edge of the closure. The progressive descent of the centering press (7) during the lowering of the mandrel (10) can be either mechanically controlled or, more simply, can be effected under its own weight. The centering press maintains a constant pressure on the gasket (5) which is progressively compressed by the tension caused by the action of shaping the closure edge.

Figure 4:
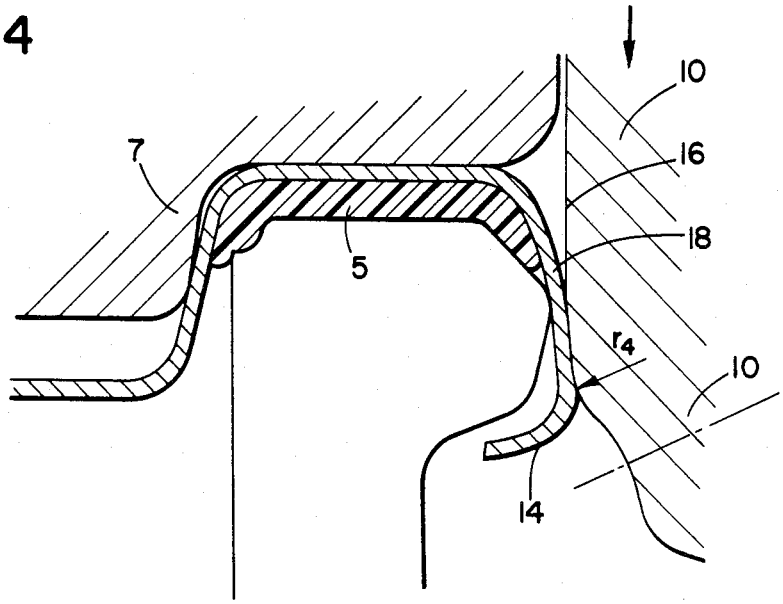
FIG. 4 represents in axial semi-cross-section the closure after the rolling stage and at the start of the pressing stage of fitting.

For example, the closure blank (1) is shaped from a sheet or strip of aluminium alloy 5052 according to Aluminium Association specification, of a thickness between 0.2 and 0.4 mm and a hardness of between H22 and H28 according to NF A 02-006 Standard, and the initial thickness of the gasket (5) is between 0.6 and 1 mm. As is typical in the case of a glass jar, the exterior of the jar edge can be inscribed in perpendicular section within a circle of radius ($r_1$) between 2 and 5 mm, the outer edge (14) of the closure (1) is pre-bent with a radius ($r_2$) between 1.5 and 4 mm and the profile (15) of the annular mandrel is curved with a radius (R) between 3 and 8 mm and its axis of symmetry in vertical section as shown in FIG. 4, makes an angle of between 30° and 60° with the axis of symmetry common to the edge of the vessel and the closure, an axis indistinguishable from the axis of symmetry of the revolution of the annular mandrel (10) in the case of this example. The extremity (19) of the outer edge (14) of the closure can be located within the curved section of inner radius ($r_2$) or can be an extension not a part of this curved section. The outer diameter of the centering press (7) is typically equal to or slightly greater by 0.5 to 1.5 mm than the outer diameter of the lip (4) of the vessel (diameter at point (12) in the case of FIG. 2) and the mandrel (10) slides with a small clearance—less than 0.2 mm —around the centering press (7). The edge of the closure (18, 14, 19) will preferably have no discontinuity of type or shape.

The method of this invention has been thus applied to cylindrical glass jars having the following dimensions:

diameter of opening: 72.5 mm;

outer diameter of the body of the jar: 78.5 mm;

outer diameter of the beaded edge: 82.5 mm;

height of the beading: 3 mm;

with closure blanks made of 0.25 mm thick semi-hard aluminium alloy 5052 made from circular blank discs of diameter 94 mm;

a central depression 3 mm deep and a periphery in the shape of a truncated cone with a diameter at mid-height of 71.5 mm, making a generatrix angle with the axis of about 8°;

outer diameter of the blank 86 mm, with an outer edge (4) bent through 120° about an inner radius ($r_2$) of 2 mm, the free end (19) passing through a circular gauge of 83 mm inner diameter.

A compressible elastic gasket of thickness 0.7 to 0.8 mm applied by spray gun onto the inner supporting surface (20).

The centering press had a centering protrusion (8) of diameter 71.5 mm and height 1.5 mm, and its outer diameter was 83.5 mm. The annular mandrel had an inner vertical surface (16) of diameter 83.6 mm, running freely around the centering press which thus served not only to centre the closure blank (1) but also the annular mandrel (10) during its movement.

The pressure was applied by a single head to the centering press by means of a spring, and to the annular mandrel. A precise vessel recentering effect was observed at the beginning of the operation, improving the initial centering by 0.3 to 0.4 mm. The force was limited to 45 kg on the centering press; the maximum force registered on the combination of the centering press (spring pressure) and the annular mandrel (fitting action) was between 100 and 110 kg for a series of fifteen jars.

In the case of airtight vacuum sealing of preserve jars by a method of water vapour injection and condensation, it is important not to release the pressure on the closure too suddenly, so as to allow for decompression of the thick elastic gasket and to avoid air leaking back in. Elastic pressure on the centering press is preferable, so as simultaneously to promote the precise self-centering of the vessel and to prevent re-entry of air at the close of the fitting procedure.

The following general prescriptions can also be followed, especially following trials:

1. The closure blank should preferably have a central depression of a depth between 1.5 and 4 mm with a periphery sustantially in the shape of a truncated cone in which the generatrices in axial cross-section make an angle of 5° to 10° with the direction of the axis, and with a diameter equal to that of the mouth of the jar.

Following on from the support section (20) the intermediate sloped section (18) makes, typically, an angle of 30° to 60° with the direction of the axis. The outer edge (14) following on from this intermediate section (18) is preferably bent through 100° to 140° with an inner radius ($r_2$) of between 0.5 times and 0.8 times that ($r_1$) of the circle which inscribes the outer edge of the beaded lip (4) of the vessel in axial section.

The overall outer diameter of the closure blank (1), that is the diameter of its outer edge (14), has a value typically equal to the outer diameter of the beaded lip (4) of the vessel with the addition of 0.8 times to 1.3 times the height of this lip (4).

Thus the method can be carried out with a closure blank of reduced surface area, its annular toroidal section (3 or again 20+18+14) having in axial semi-cross-section a developed length of between 0.9 times and 1.2 times the total developed length of the rim (6) and having the same side and under-surface contours as the lip (4) of the vessel.

The thick elastic gasket, of a thickness typically between 0.6 and 1 mm, can be made, for example, from a plastisol of plasticized PVC and poured, extruded or simply placed and, if desired, glued, in a known and usual fashion.

2. The apparatus should preferably have the following features:

The centering press (7) which effects the centering of the closure blank has in the center of its surface which touches the support section (20) of the closure blank (1) a centering protrusion (8) of a height less than the depth of the central depression (2) of said blank (1) and of a diameter such that it cooperates with the truncated side wall (9) of the central depression (2) as a push fit.

Preferably an annular mandrel (10) is used in which the sloped outer profile (15) has a radius (R) of between 1.5 times and 2.5 times the radius of that circle which inscribes the outer edge of the lip (4) of the vessel in axial section. The inner vertical surface (16) of the mandrel (10) should have, perpendicularly to its axis of revolution, a diameter equal to the maximum diameter of the beaded lip (4) of the vessel with the addition of twice the thickness of the closure blank (1) and between 0.05 and 0.2 mm.

The inclined curved profile (15) is contained between an engaging surface at the base of the annular mandrel (10), the surface of ridge ($r_3$) in axial section, and a surface engaging with the interior vertical surface (16) of radius ($r_4$): in order that the first shaping of the closure blank is properly done, it is necessary that the bottom of the curved profile (15), that is the meeting point of the curved engaging surface of radius ($r_3$) and that profile (15) has, perpendicularly to the axis of symmetry of the apparatus, a diameter preferably between the outer diameter of the closure blank (1) less twice the inner radius ($r_2$), and that same diameter of the blank (1) less 0.5 times ($r_2$);

the annular mandrel (16) should slide freely with a slight clearance around the centering press (7) to ensure its centering with respect to the closure blank (1).

The method can, if desired, be executed with, instead of an annular mandrel, several mandrels coming into simultaneous or successive contact with several parts of the periphery of the outer edge of the closure.

This method is particularly useful in preserving foods or pharmaceutical products in glass jars. It can equally be applied to the fitting of closures onto any other container which has an edge which is beaded and sufficiently rigid. In a way which is convenient for the user, the closure can be an easily opened closure, for example for preserves to be used at the first opening, or, for preserves intended for repeated use, the jar can be provided with an outer closure for repeated closing.

The invention is typically useful for glass jars with an opening of diameter between 50 and 110 mm.

What is claimed is:

1. A method for fitting a metal closure on a vessel having a circular edge comprising a rigid beaded lip (4), by means of fitting apparatus comprising a centering press (7) and an annular mandrel means (10) comprising an inclined inner curved profile (15) and a vertical inner surface, comprising the steps of:

(a) forming a closure blank (1) comprising a central depression (2) with a lateral wall (9) of substantially truncated conical shape and with a diameter slightly smaller than the diameter of the mouth of the vessel, and an annular toroidal section (3) which comprises in immediate succession:
   - an annular support section (20) generally perpendicular to said lateral wall,
   - an intermediate section (18) inclined outwardly and downwardly with respect to said annular support section, and
   - an outer edge (14) curved inwardly and downwardly with respect to said intermediate section and bent through an angle of 100° to 140°, with, in axial section, an inner radius of curvature of between 0.5 times and 0.8 times the radius of a circle which contains the outer contour of the edge of said beaded lip;

(b) positioning a thick endless elastic gasket (5) on the inside of the support section (20) of the closure blank (1);

(c) positioning the closure blank (1) under the centering press (7) of the fitting apparatus, and positioning the vessel beneath the closure blank (1);

(d) progressively pressing the closure blank (1) with its thick elastic gasket (5) onto the rim (6) of the vessel with the aid of the centering press (7) until a predetermined pressure is reached;

(e) during and after said step (d), shaping, fitting and tightening the closure blank (1) to seal on to the lip (4) of the vessel, by means of said annular mandrel means (10) according to the shaping steps of:
   - (e1) stretching, forcing downwardly and tightening the bent outer (14) and the intermediate section (18) by the pressure of the annular mandrel means (10) on said bent outer edge (14), and by the rolling of said edge in the inclined inner curved profile (15) of said annular mandrel means (10);
   - (e2) continuing this shaping of the outer edge (14) and of the intermediate section (18) of the closure blank (1), and at the same time forcing the extremity (19) of said outer edge (14) under the beaded lip (4) of the vessel by the upper engaging surface above said inclined inner curved profile and by the engaging of the vertical inner surface (16) of said annular mandrel means (10) around said outer edge and intermediate section (14+18);
   - (e3) achieving the sealed fitting of the closure (1) on the beaded lip (4) of the vessel by its being forced by the camming action of the vertical inner surface (16) of the annular mandrel means (10) around the outer edge (14+18) of the closure (1), this beig done at least until the bottom of the said vertical surface (16) reaches a level below the beaded lip (4) of the vessel.

2. A method according to claim 1, characterized in that, in axial semi-cross-section, the annular toroidal part (3 or 20+18+14) has a developed length of between 0.9 times and 1.2 times the total length of the rim (6) and of the outer contour of the beading of the lip (4) of the vessel.

3. A method according to any of claims 1 or 2, characterized in that the fitting apparatus has an annular mandrel (10) with the following features:
   - its inclined inner curved profile (15) has, in axial section, a radius (R) of between 1.5 times and 2.5 times the radius ($r_1$) of the circle which contains the outer contour of the beaded edge of the lip (4) of the jar, and has an axis of symmetry making an angle of between 30° and 60° with the axis of symmetry common to the vessel and the closure;
   - its inner vertical surface (16) has, perpendicularly to its axis of rotational symmetry, a diameter equal to the maximum diameter of the beaded lip (4) of the vessel with the addition of twice the thickness of the closure blank (1) and of between 0.05 and 0.2 mm.

4. A method according to claim 1 characterized in that the bottom of the inner curved profile (15), defined by the meeting point of that profile with the lower engaging surface of radius ($r_3$), has, perpendicularly to the axis of rotational symmetry of the apparatus, a diameter intermediate the outer diameter of the closure blank (1) less twice the inner radius ($r_2$) of the outer edge (14) of said blank (1) and that same diameter of the blank (1) less 0.5 times the said inner radius ($r_2$).

5. A method according to any of claims 1, characterized in that the shaping, fitting and sealing of the closure blank (1) onto the lip (4) of the vessel according to stage (e), are effected in a single operation by the descent of the annular mandrel (10) sliding around the centering press (7).

6. A method according to claim 1, characterized in that the vessel with the rigid beaded lip (4) on its circular edge is a glass jar.

7. A method according to claim 1, characterized in that the closure blank (1) is made of aluminium or aluminium alloy.

8. A method to claim 1, wherein said annular mandrel means comprises an annular mandrel.

9. A method to claim 1, wherein said annular mandrel means comprises a plurality of outlying mandrels.

* * * * *